US006776293B1

(12) United States Patent
Gunnarsson

(10) Patent No.: US 6,776,293 B1
(45) Date of Patent: Aug. 17, 2004

(54) APPARATUS FOR SORTING TIMBER

(75) Inventor: Cenneth Gunnarsson, Vislanda (SE)

(73) Assignee: C. Gunnarssons Verkstads AB, Vislanda (SE)

( * ) Notice: Subject to any disclaimer, the term of this patent is extended or adjusted under 35 U.S.C. 154(b) by 0 days.

(21) Appl. No.: 10/070,986

(22) PCT Filed: Sep. 11, 2000

(86) PCT No.: PCT/SE00/01752

§ 371 (c)(1),
(2), (4) Date: Mar. 14, 2002

(87) PCT Pub. No.: WO01/21331

PCT Pub. Date: Mar. 29, 2001

(30) Foreign Application Priority Data

Sep. 15, 1999 (SE) ..... 9903275

(51) Int. Cl.[7] ..... B07C 5/14
(52) U.S. Cl. ..... 209/517; 209/657; 198/370.09
(58) Field of Search ..... 209/517, 518, 209/657, 656, 941; 198/361, 370.09

(56) References Cited

U.S. PATENT DOCUMENTS

| | | | | |
|---|---|---|---|---|
| 1,020,746 A | * | 3/1912 | Dehler | 198/361 |
| 1,794,331 A | * | 2/1931 | Klyver et al. | 198/361 |
| 1,910,965 A | * | 5/1933 | Regan | 198/349 |
| 2,902,150 A | | 9/1959 | Rambo | |
| 3,116,835 A | * | 1/1964 | Brandon | 209/520 |
| 3,379,307 A | * | 4/1968 | Dron | 414/798.7 |
| 3,782,540 A | | 1/1974 | Mosely | |
| 3,927,755 A | * | 12/1975 | Ritola | 198/370.09 |
| 4,195,737 A | * | 4/1980 | Rysti | 209/521 |
| 4,358,009 A | | 11/1982 | Rysti | |

FOREIGN PATENT DOCUMENTS

WO WO 01/19538 A1 3/2001

OTHER PUBLICATIONS

International Search Report dated Feb. 13, 2000 (PCT/SE00/01752).

* cited by examiner

*Primary Examiner*—Donald P. Walsh
*Assistant Examiner*—Joseph C Rodriguez

(57) ABSTRACT

An apparatus for sorting individual timber pieces of different dimensions and or qualities into a number of mutually superposed sorting compartments (1) comprises a conveyor and a transfer device (12). The conveyor transports individual timber pieces places in the vertical direction along the infeed ends of the sorting compartments (1). The longitudinal direction of the timber pieces is approximately horizontal and transversely directed in relation to the longitudinal direction of the sorting compartments (1). The transfer device (12) transfers a specific timber piece place from the conveyor to a specific sorting compartment (1). The transfer device (12) has a least one transfer member (13) per sorting compartment (1). Each transfer member (13) is movable between a passive position outside the path (4) of the conveyor and an active position within the path (4) of the conveyor. The path (4) of the conveyor is substantially vertical and rectilinear and located a distance (11) from the infeed ends of the sorting compartments (1).

20 Claims, 2 Drawing Sheets

APPARATUS FOR SORTING TIMBER

TECHNICAL FIELD

Figure 1:
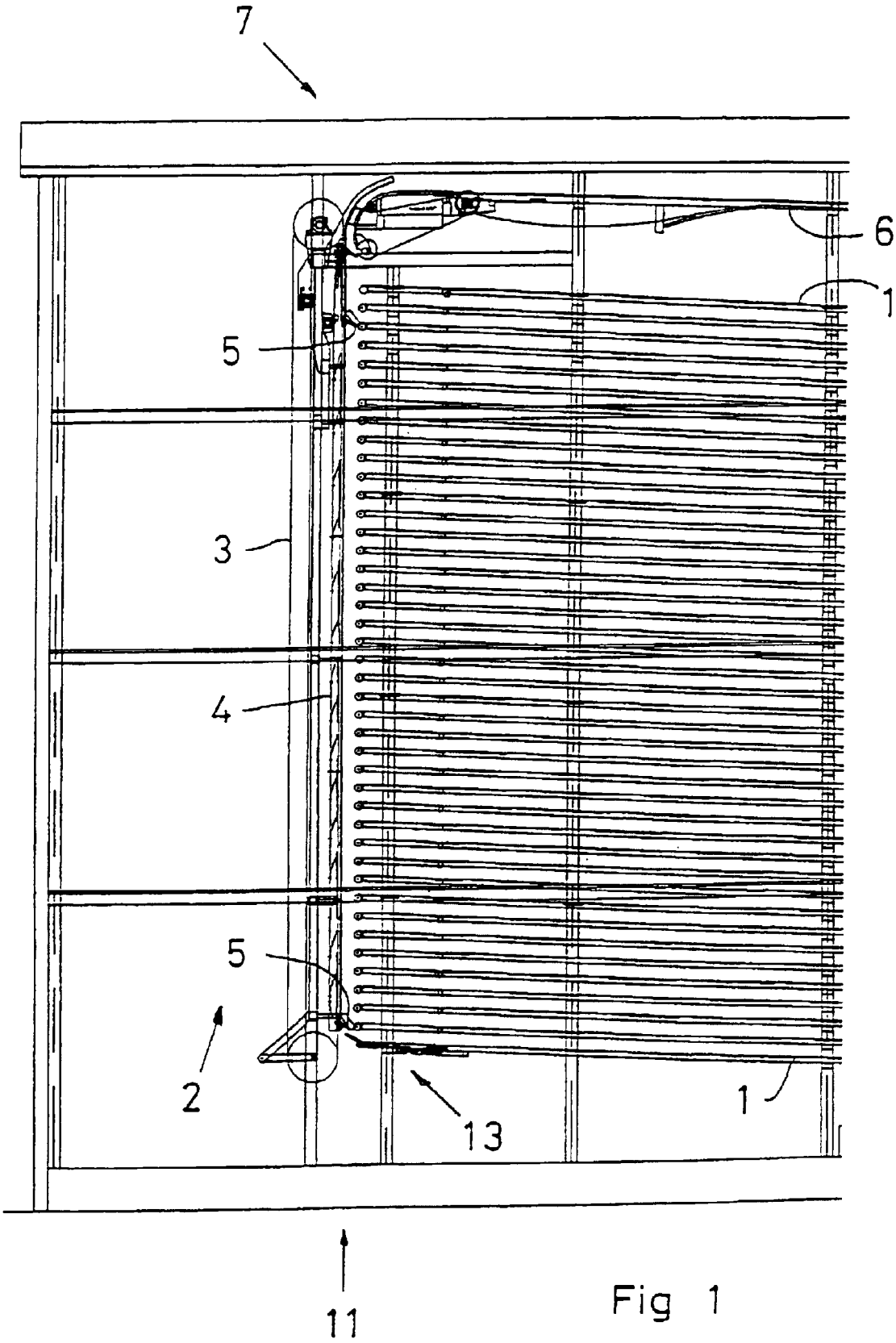

The present invention relates to an apparatus for sorting individual timber pieces of different dimensions and/or qualities into a number of mutually superposed sorting compartments, and comprising a conveyor for vertical transport along the infeed ends of the sorting compartments of individual timber pieces with their longitudinal direction approximately horizontal and transversely directed in relation to the longitudinal direction of the sorting compartments, and a transfer device for transferring a specific timber piece from the conveyor to a specific sorting compartment.

BACKGROUND ART

Apparatuses of the type intimated by way of introduction are previously known in the art. The individual sorting compartments are represented by approximately horizontal conveyors of considerable length, of the order of magnitude of 50–100 m or possibly more. These conveyors are superposed on one another with a spacing of approximately 30–40 cm. The number of sorting compartments in the vertical direction may be large, often as many as 30–50 in number.

Along the infeed ends of the sorting compartments, a conveyor runs which transports the individual timber pieces up to a certain, predetermined sorting compartment where the timber piece is discharged by means of a transfer device and is fed into the selected sorting compartments. The individual timber pieces may arrive in random sequence as regards dimensions and qualities, but are identified and registered by a computer which controls the transfer devices so that the timber pieces are fed to the correct sorting compartment. The conveyor which runs in conjunction with the infeed ends of the sorting compartments moves continuously.

The transfer devices have hitherto been placed in the downwardly moving conveyor which is in conjunction with the infeed ends of the sorting compartments. This implies that, when a transfer device is activated, it must extend through the path which the individual timber pieces described on the downwardly moving conveyor. This entails that a transfer device must be activated, transfer its timber piece to the associated sorting compartment and thereafter return to the starting position outside the path of movement of the timber pieces before a new timber piece may pass. Such a work cycle takes considerable time, and so capacity will not be that intended.

It has thus been the work rate of the transfer devices which has hitherto limited the overall capacity of the plant. As a result, it has not been possible to carry out such working operations as sawing, normal mechanised transport within the plant, cutting-to-length, etc., at maximum speed, for which reason the plant as a whole has too low capacity.

In order to attempt to increase the capacity of the plant, the time available for each working cycle in the transfer devices has been increased. This has been achieved by an increase of the linear transport length for each timber piece on the downwardly moving conveyor from the uppermost sorting compartment to the lowermost. In order to achieve this, the downwardly moving conveyor has been inclined in that the individual sorting compartments do not begin in a vertical plane but in a plane which inclines to the vertical. This has been realised in that an upper sorting compartment extends out beyond a subjacent sorting compartment. Given that the downwardly moving conveyor follows this pattern and, hence, in principle maintains constant distance to the mouths of the sorting compartments, the linear transport length in the downwardly moving conveyor will be longer than would have been the case if the sorting compartments had been arranged with their infeed ends in a vertical plane.

The above-described oblique inclination of the infeed ends of the sorting compartments entails that the lowermost, and hence the shortest, sorting compartment will be dimensioned for the entire plant, for which reason extra costs are incurred for the unnecessarily long upper sorting compartments.

Furthermore, despite the oblique inclination of the conveyor, it has not been possible to achieve the work rate for the plant which is desirable.

PROBLEM STRUCTURE

The present invention has for its object to design the apparatus intimated by way of introduction such that the drawbacks inherent in prior art technologies are obviated. In particular, the present invention has for its object to design the apparatus according to the present invention so that its capacity is greatly improved as compared with prior art technology. Further, the present invention has for its object to obviate the need for unnecessarily long sorting compartments.

SOLUTION

The objects forming the basis of the present invention will be attained if the apparatus intimated by way of introduction is characterised in that the transfer device has at least one transfer member per sorting compartment, and that each transfer member is movable between a passive position outside the path of the conveyor and in conjunction with the infeed end of the sorting compartment, and an active position within the path of the conveyor for engagement with a timber piece carried by the conveyor and transferring it to the sorting compartment.

BRIEF DESCRIPTION OF THE ACCOMPANYING DRAWINGS

Figure 2:
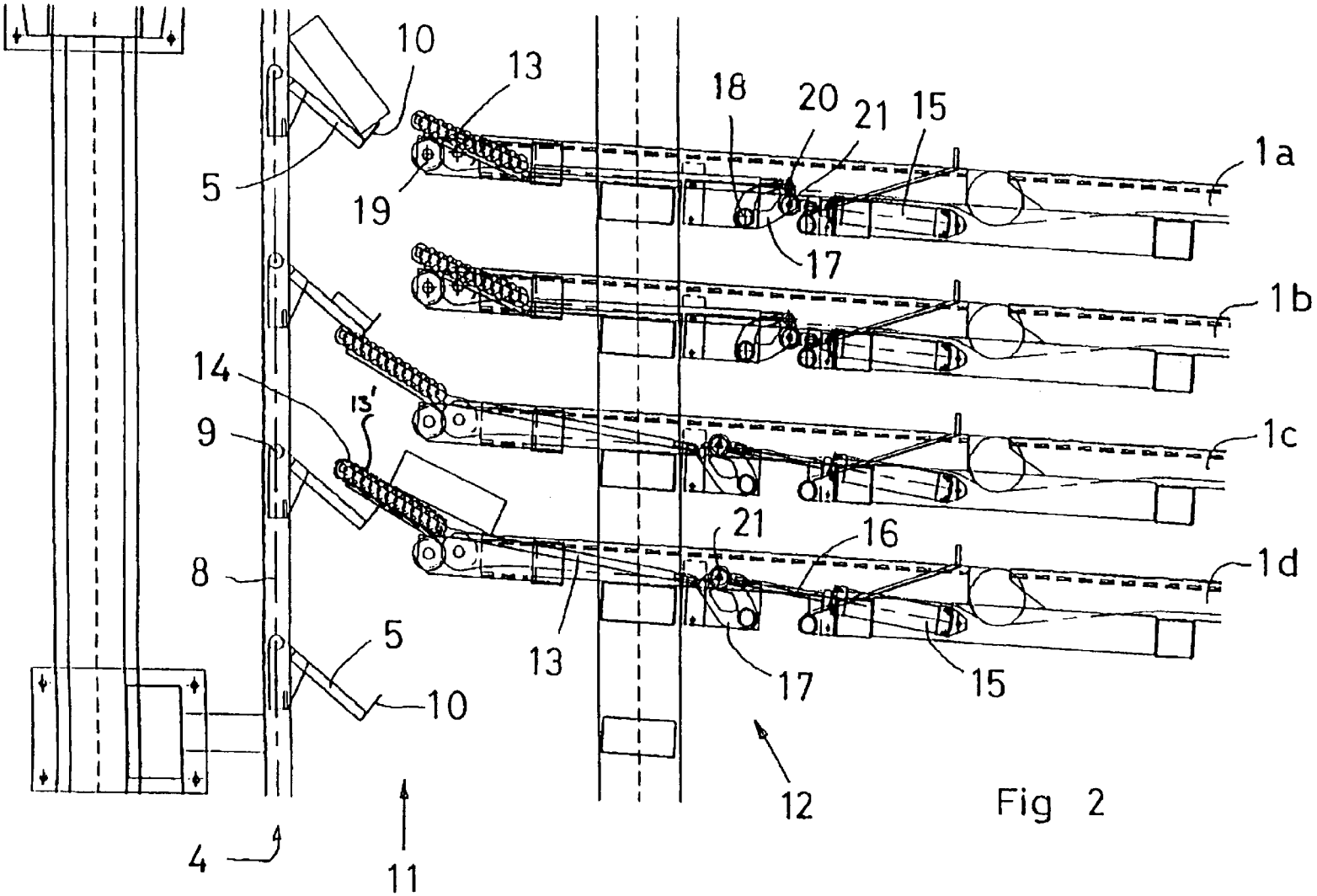

The present invention will now be described in greater detail hereinbelow, with particular reference to the accompanying Drawings. In the accompanying Drawings:

FIG. 1 is a vertical side elevation of the infeed ends of an arrangement of mutually superposed sorting compartments; and FIG. 2 is a vertical side elevation, on a larger scale, of the apparatus according to the present invention.

DESCRIPTION OF PREFERRED EMBODIMENT

FIG. 1 is a vertical side elevation of one end of a plant for sorting timber, so that the timber, after sorting, will be arranged according to timber dimension and quality, with each dimension and quality separately or possibly a range of dimensions or qualities together in each sorting compartment. The plant is based on a bearing structure of steel beams and, in the illustrated embodiment, is of a height of approximately 20 m. The plant includes a number of sorting compartments 1 for accommodating selected timber pieces. The sorting compartments 1 are superposed on one another with a spacing in the vertical direction of 30–40 cm. Each sorting compartment includes a number of conveyors disposed at the same height and parallel with one another and supporting the timber pieces which lie only in one layer in each sorting compartment and which have their longitudinal direction horizontal and at right angles to the longitudinal directions of the conveyors and the sorting compartments, i.e. at right angles to the plane of the Drawings in FIGS. 1 and 2.

At the left-hand end of the sorting compartments in FIG. 1, there is disposed a vertically running conveyor 2 with an upwardly moving part 3 and a downwardly moving part 4. The conveyor 2, which may suitably be vertical, has a number of uniformly spaced carriers 5 of which only an upper and a lower are intimated on the downwardly moving part 4. The carriers 5 are intended for carrying individual timber pieces such that these have their longitudinal direction horizontal and at right angles to the plane of the Drawings in FIG. 1. While only one conveyor 2 is shown in FIG. 1, it is assumed that at least two, but preferably three or four conveyors are disposed parallel with one another and with the carriers 5 at the same height so that a timber piece is, in practice, carried by a number of carriers 5.

For feeding timber pieces to the vertical conveyor 2, an incoming conveyor 6 is disposed uppermost in the beam frame and transports individual timber pieces in a direction from right to left in FIG. 1. In what sequence and what dimensions or qualities, respectively, the individual timber pieces have on the incoming conveyor 6 have previously been sensed and corresponding information stored in a computer. The individual timber pieces have thereby been allocated their own address, i.e. a sorting compartment 1 of their own.

Between the incoming conveyor 6 and the vertical conveyor 2, there is disposed a tilter 7 where each individual timber piece is displaced from the incoming conveyor 6 to one of the carriers 5 included in the vertical conveyor 2. During this transfer of the individual timber pieces, they are turned over so that the original underside will be turned to face upwards when the timber pieces lie on the carriers 5.

The transfer of the individual timber pieces from the incoming conveyor 6 to the individual carriers 5 of the vertical conveyor 2 takes place in such a manner that the position of each individual timber piece is known on the downwardly moving part 4 of the vertical conveyor 2.

FIG. 2 shows a partial magnification of a part of FIG. 1, and this part may be located anywhere whatever in the vertical direction of the downwardly moving part 4 of the vertical conveyor.

It will be apparent from the Figure that the downwardly moving part 4 includes a profile rail 8 in which runs a chain which supports the individual carriers 5. The carriers are further guided interiorly in the profile rail with the aid of rollers 9. It will be apparent from the Figure that the carriers 5 incline downwards in a direction away from the profile rail 8 and in a direction towards the sorting compartments 1. Further, each carrier 5 has an upstanding arrest member 10 at its free end.

It will be apparent from FIG. 1 that the infeed ends of the sorting compartments 1 lie straight above one another in a common and substantially vertical plane. It will also be apparent that, between this plane and the carriers 5 of the downwardly moving part 4, there is a gap or interspace 11 which is substantially of uniform width throughout its vertical extent and which, for reasons of capacity, must be as narrow as is practically possible. Further, the free ends 10 of the carriers 5 move in a substantially vertical plane which is parallel with, or at least substantially parallel with, the plane defined by the infeed ends of the sorting compartments 1.

At the infeed end of each sorting compartment 1, there is disposed a transfer device 12 which has a transfer member 13 which is disposed for transferring an individual timber piece on a carrier 5 to the infeed end of a specific sorting compartment. The transfer device 12 is placed on that side of the interspace 11 which is turned to face towards the sorting compartments 1. Each transfer member 13 in the transfer devices 12 is movable between a passive position with an outer end portion outside the path which is defined by the timber pieces on the downwardly moving part 4 of the conveyor 2 and in conjunction with the infeed end of the sorting compartment 1, and an active position with the end portion within the above-mentioned path for engagement with a timber piece carried by the conveyor 2 and transferring it to the sorting compartment 1.

In FIG. 2, both of the transfer members 13 disposed uppermost in the Figure, i.e. those transfer members disposed in conjunction with sorting compartments 1*a* and 1*b*, are in their passive positions, while the transfer members which are disposed in conjunction with sorting compartments 1*c* and 1*d* are located in their projecting, active positions. It will further be apparent that the outer end of the transfer members 13 at the sorting compartments 1*a* and 1*b* are located a slight distance from the carriers 5 and the timber pieces resting on them. This distance should be as slight as possible, since the necessary length of movement between the passive and active positions of the transfer members 13 will then be shorter, as also applies to the time for a work cycle of the transfer member.

The transfer member 13 in conjunction with the sorting compartment 1*c* is located in its projecting, active position, and it will be apparent that the timber piece on the carrier located immediately above the transfer member will be lifted free from the arrest member 10 when the carrier continues its downward movement. In such instance, the timber piece will rest on the transfer member 13 which inclines to the horizontal plane in approximately the same manner as the carriers 5 incline downwards. Given that the downwardly directed movement and speed of the timber piece on the carrier 5 will be deflected into a movement and speed along the transfer member 13, the relevant timber piece will slide along the upper side of the transfer member or roll on the rollers 14 which are provided there. The timber piece on the lowermost transfer member shown in the Figure at sorting compartment 1*d* has partly been displaced along the transfer member in a direction to the right in on the sorting compartment 1*d* where it is transported further in a direction to the right.

Each transfer member 13 is movable substantially in a translation movement which is generated by a cylinder unit 15 with a piston rod or ram 16. The free end of the piston rod 16 is pivotally secured at 21 in a rocker 17 which is pivotal about a shaft 18. The transfer member 13 proper is also pivotally secured in the rocker 17 at a pivot shaft 20. The outer and obliquely upwardly directed end portion of the transfer member is guided by and supported on a roller 19. Thus, the end portion may be lifted up from the roller 19.

When the apparatus according to the present invention is to work with varying widths of timber pieces, it is appropriate to design the drive means for the transfer members 13 in such a manner that the length of the translation movement is adjustable. In narrow timber pieces, a shorter movement may be selected, which increases the work rate of the transfer device. On the other hand, in wide timber pieces a longer length of movement is selected in order to ensure that the wide timber piece may reliably be able to rest on the end section of the transfer member 13 when it is lifted free of the carrier 5 on which it has rested.

The above-described geometry entails that the transfer member 13, in particular its outer end section, superposed on the translation movement, also has vertical movement components. Because of the angling of the transfer member 13 upwards in a direction in towards the vertical conveyor and its support on the roller 19, it will have, from the active position (at compartments 1*c* and 1*d*), a considerable downward movement, for which reason the risk is greatly reduced that a timber piece which is in the process of being transferred from a carrier 5 to the transfer member 13 will bounce—both are moving downwards. This downwardly directed movement also entails that the risk is reduced that the next carrier 5 and timber piece resting thereon will collide with an end section of a transfer member 13 which is on its way in towards a sorting compartment 1.

Further, the angle of the transfer member 13 in relation to a horizontal plane is greater in the active position (corresponds more closely to the inclination of the carrier 5) than is the case in the passive position.

The speed of the transfer member 13 is not uniform, thus the illustrated geometry gives a relatively slow acceleration/retardation in the proximity of the passive position, for which reason a timber piece is gently braked to a speed which is suitable for infeed into a sorting compartment. In the active, projecting position, the acceleration/retardation is considerably greater, for which reason the transfer member 13 on return to its passive position will rapidly achieve a speed which corresponds to or exceeds the speed of movement of the timber piece.

As an alternative to the roller path with the rollers 14 on the outer section of the transfer members, it is also possible to employ a driven belt 13' which circulates with its upper part in a direction in towards the sorting compartment 1. This is shown by the dashed lines in FIG. 2, which represents an alternative embodiment of the present invention. In such a construction, each timber piece is driven by machine power in towards the sorting compartment 1 and is not exclusively reliant on force of gravity and the movement which has been imparted to a timber piece by carrier 5.

The retraction of the transfer member 13 and a timber piece resting thereon may be initiated as soon as the timber piece rests so securely on the transfer member 13 that there is no need to fear that it will fall down over the free end of the transfer member 13. In order to reduce this risk and in order to increase the acceleration in a direction to the right in FIG. 2 which the transfer member 13 may undergo in its return movement back to the passive position, the rollers 14 may be provided with a friction-increasing coating and one-way locks to prevent rotation in the wrong direction.

In terms of performance, the present invention realises a considerable improvement over the prior art technology disclosed by way of introduction. This is partly based on the foregoing, but is also because of the fact that the counterpart to the transfer member of the present invention in prior art technology must execute a complete return movement from its discharge position in the sorting compartment and through the path which the timber pieces follow along the downwardly moving conveyor before it is back at its starting position and a new timber piece may pass.

What is claimed is:

1. An apparatus for sorting individual timber pieces of different dimensions and/or qualities into a number of mutually superposed sorting compartments, comprising:

a conveyer for vertical transport along infeed ends of the sorting compartments of individual timber pieces with their longitudinal direction approximately horizontal and transversely directed in relation to the longitudinal direction of the sorting compartments, and a transfer device located wholly on a side of the conveyor facing the sorting compartments for transferring a specific timber piece from the conveyor to a specific sorting compartment, wherein the transfer device has at least one transfer member per sorting compartment; and wherein each transfer member is movable between a passive position outside the path of the conveyor and between said path and the sorting compartment and in conjunction with the infeed end of the sorting compartment, and an active position within the path of the conveyor for engagement with a timber piece carried by the conveyor and transferring it to the sorting compartment.

2. The apparatus as claimed in claim 1, wherein the conveyor has a substantially vertical and rectilinear path of movement from above and downwards, which is located a slight distance from the infeed ends of the sorting compartments, which lie substantially in a common vertical plane.

3. The apparatus as claimed in claim 1, wherein the transfer members are elongate and substantially straight with a slightly obliquely upwardly end section, and extend in their active positions in the longitudinal direction out from the infeed ends of the sorting compartments and with the end section slightly obliquely upwards towards the conveyor.

4. The apparatus as claimed in claim 1, wherein said transfer members have roller paths at least on the upper side of an end section.

5. The apparatus as claimed in claim 1, wherein an end section of the transfer members has circulating driven belts on which the timber pieces rest and which impart to the timber pieces an additional movement in a direction towards a sorting compartment.

6. The apparatus as claimed in claim 1, wherein the conveyor has carriers for supporting a timber piece with approximately horizontal longitudinal direction; and that the carriers incline obliquely downwards in a direction towards infeed ends of the sorting compartments.

7. The apparatus as claimed in claim 6, wherein said carriers and the end sections of said transfer members have approximately the same inclination.

8. The apparatus as claimed in claim 1, wherein the transfer member has a different angle in relation to the horizontal plane in the active position and the passive position.

9. The apparatus as claimed in claim 1, wherein an angle of the active position is greater than an angle of the passive position in relation to a horizontal plane.

10. An apparatus for sorting individual timber pieces of different dimensions and/or qualities into a number of mutually superposed sorting compartments, comprising:

a conveyer for vertical transport along infeed ends of the sorting compartments of individual timber pieces with their longitudinal direction approximately horizontal and transversely directed in relation to the longitudinal direction of the sorting compartments, and a transfer device for transferring a specific timber piece from the conveyor to a specific sorting compartment, wherein the transfer device has at least one transfer member per sorting compartment; and wherein each transfer member is movable between a passive position outside the path of the conveyor and between said Path and the sorting compartment and in conjunction with the infeed end of the sorting compartment and an active position within the path of the conveyor for engagement with a timber piece carried by the conveyor and transferring it to the sorting compartment, wherein said transfer members are movable in a substantially translation movement to and from active position.

11. The apparatus as claimed in claim 10, wherein the translation movement of the transfer member in a region of its active position on return towards the passive position, there is superposed a downwardly directed movement component at the end section of the transfer member.

12. The apparatus as claimed in claim 10, wherein the transfer member has a different angle in relation to the horizontal plane in the active position and the passive position.

13. The apparatus as claimed in claim 10, wherein an angle of the active position is greater than an angle of the passive position in relation to a horizontal plane.

14. An apparatus for sorting individual timber pieces of different dimensions and/or qualities into a number of mutually superposed sorting compartments, comprising:

a conveyer for vertical transport along infeed ends of the sorting compartments of individual timber pieces with their longitudinal direction approximately horizontal and transversely directed in relation to the longitudinal direction of the sorting compartments, and a transfer device for transferring a specific timber piece from the conveyor to a specific sorting compartment, wherein the transfer device has at least one transfer member per sorting compartment;

wherein each transfer member is movable between a passive position outside the path of the conveyor and in conjunction with the infeed end of the sorting compartment, and an active position within the path of the conveyor for engagement with a timber piece carried by the conveyor and transferring it to the sorting compartment;

wherein said transfer members are movable in a substantially translation movement to and from active position, wherein the translation movement for the transfer members is of adjustable length.

15. An apparatus for sorting individual timber pieces of different dimensions and/or qualities into a number of mutually superposed sorting compartments, comprising:

a conveyor for transport along infeed ends of the sorting compartments of individual timber pieces with their longitudinal direction approximately horizontal and transversely directed in relation to the longitudinal direction of the sorting compartments;

a transfer device located wholly on a side of the conveyor facing the sorting compartments for transferring a specific timber piece from the conveyor to a specific sorting compartment, the transfer device having at least one transfer member in association with each sorting compartment, and each transfer member having a gripping position for gripping a timber piece carried by the conveyer, a transfer position for transferring the timber piece gripped in the gripping position into the associated sorting compartment and a passive, inoperative rest position, said rest position and said transfer position being both located on the same side of the conveyor, which is that side facing the sorting compartments.

16. The apparatus as claimed in claim 15, wherein the transfer member has a different angle in relation to the horizontal plane in the active position and the passive position.

17. The apparatus as claimed in claim 15, wherein an angle of the active position is greater than an angle of the passive position in relation to a horizontal plane.

18. An apparatus for sorting individual timber pieces of different dimensions and/or qualities into a number of mutually superposed sorting compartments, comprising:

a conveyer for transport along infeed ends of the sorting compartments of individual timber pieces with their longitudinal direction approximately horizontal and transversely directed in relation to the longitudinal direction of the sorting compartments;

a transfer member being movable from a rest position to a gripping position in a direction from the infeed ends of the sorting compartments towards the conveyer to grip a timber piece carried thereby and then back ft to a transfer position where the timber piece gripped in the gripping position is transferred to a specific sorting compartment.

19. The apparatus as claimed in claim 18, wherein the transfer member has a different angle in relation to the horizontal plane in the active position and the passive position.

20. The apparatus as claimed in claim 18, wherein an angle of the active position is greater than an angle of the passive position in relation to a horizontal plane.

* * * * *